US009713360B2

(12) United States Patent
Santos

(10) Patent No.: US 9,713,360 B2
(45) Date of Patent: Jul. 25, 2017

(54) REMOVABLE EXERCISE ATTACHMENT DEVICE FOR FOOTWEAR

(71) Applicant: Jose Francisco Lara Santos, Maple Grove, MN (US)

(72) Inventor: Jose Francisco Lara Santos, Maple Grove, MN (US)

( * ) Notice: Subject to any disclaimer, the term of this patent is extended or adjusted under 35 U.S.C. 154(b) by 574 days.

(21) Appl. No.: 13/803,014

(22) Filed: Mar. 14, 2013

(65) Prior Publication Data

US 2013/0239440 A1 Sep. 19, 2013

Related U.S. Application Data

(60) Provisional application No. 61/611,235, filed on Mar. 15, 2012.

(51) Int. Cl.

| | |
|---|---|
| ***A43B 5/00*** | (2006.01) |
| ***A43B 23/00*** | (2006.01) |
| ***A63B 22/18*** | (2006.01) |
| ***A63B 22/20*** | (2006.01) |
| ***A63B 21/00*** | (2006.01) |
| *A63B 69/00* | (2006.01) |
| *A63B 23/04* | (2006.01) |

(52) U.S. Cl.

CPC ..... *A43B 23/00* (2013.01); *A63B 21/4015* (2015.10); *A63B 21/4033* (2015.10); *A63B 21/4034* (2015.10); *A63B 22/18* (2013.01); *A63B 22/20* (2013.01); *A63B 21/4039* (2015.10); *A63B 69/0059* (2013.01); *A63B 2022/185* (2013.01); *A63B 2023/0411* (2013.01); *A63B 2209/10* (2013.01)

(58) Field of Classification Search

CPC ..... A63B 22/18; A63B 21/4015; A63B 2022/185; A43B 5/18; A43B 3/20; A43B 7/00; A43B 7/38; A43B 13/14

USPC ..... 36/132, 136

See application file for complete search history.

(56) References Cited

U.S. PATENT DOCUMENTS

| | | | | |
|---|---|---|---|---|
| 5,461,799 | A * | 10/1995 | Kim | A43B 5/18 36/132 |
| 6,311,416 | B1 * | 11/2001 | Cohen | A43B 7/00 36/115 |
| 7,500,324 | B1 * | 3/2009 | Power | A43B 13/145 36/132 |
| 8,397,404 | B2 * | 3/2013 | Kim | A43B 5/00 36/103 |
| 8,740,757 | B1 * | 6/2014 | FioRito | A63B 22/18 36/74 |
| 2002/0026730 | A1 * | 3/2002 | Whatley | A43B 13/143 36/132 |
| 2006/0240953 | A1 * | 10/2006 | Shahinpoor | A63B 69/18 482/77 |
| 2011/0083344 | A1 * | 4/2011 | Tambay | A43C 15/09 36/132 |

* cited by examiner

*Primary Examiner* — Jila M Mohandesi

(57) ABSTRACT

A removable exercise device attached to a users shoe for use during exercise. The device includes a variety of removable and interchangeable accessories to be used for various physical activities and exercises. These accessories are designed to place user's foot in a declined position. The accessories include wheels and bottoms with various shapes, heights, and materials.

14 Claims, 3 Drawing Sheets

FIG. 1
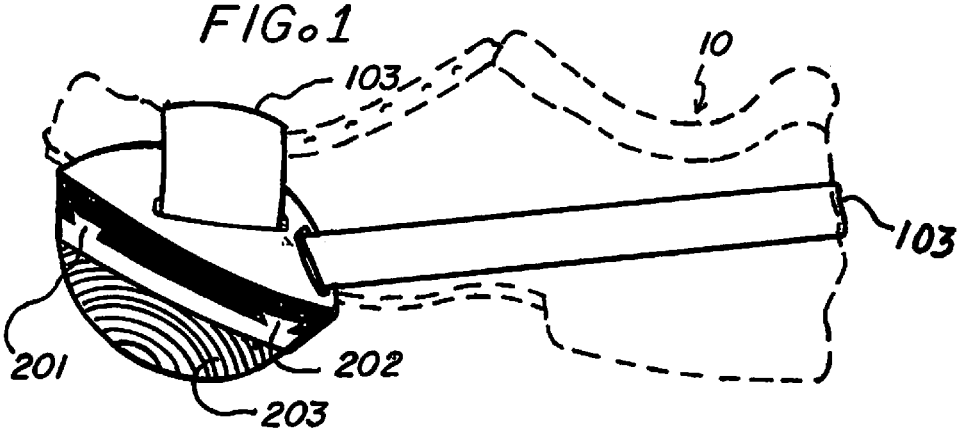
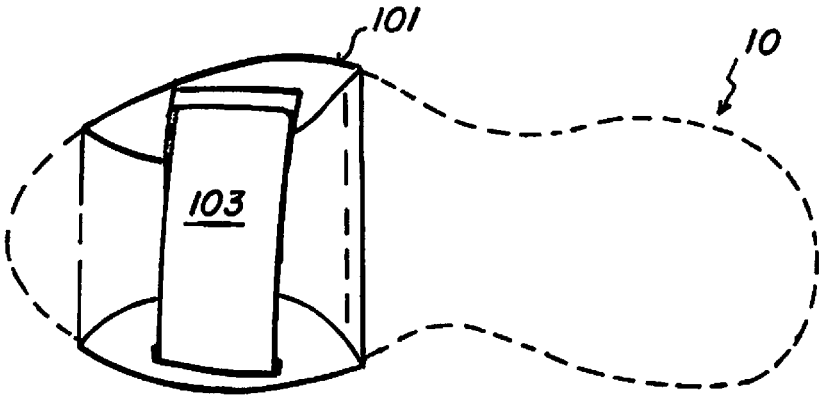
FIG. 2
FIG. 4
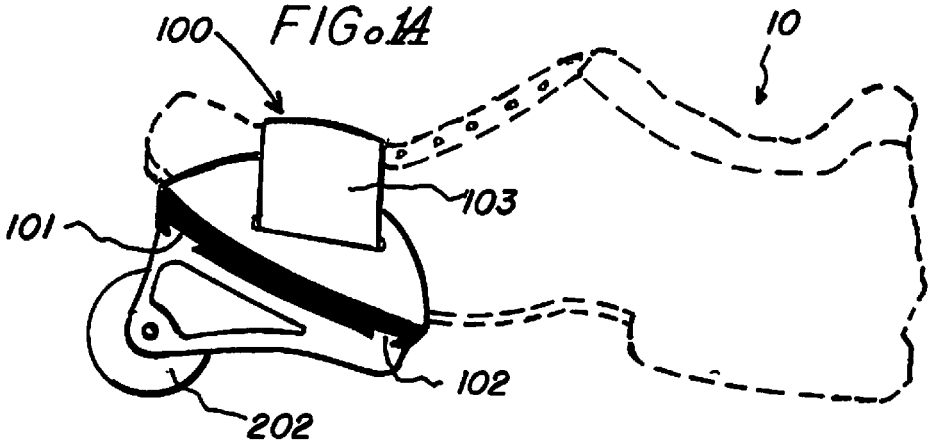

REMOVABLE EXERCISE ATTACHMENT DEVICE FOR FOOTWEAR

CROSS REFERENCE TO RELATED APPLICATIONS

This application claims the benefit of provisional patent application Ser. No. 61/611,235 filed 2012 Mar. 15 by the present inventor.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to a removable attachment placed onto a users shoe to improve their form, challenge their physical abilities, and improve their physical fitness during exercise. Specifically, the disclosed device easily attaches to the users shoe to place the foot in a declined position raising the toes above the heel of the user when doing specific exercises. This device includes multiple attachments to vary the slope of the decline and provide for other uses for specific physical exercise activities based upon the attachment used.

The benefits of placing the foot in a declined position are well known. The prior art shows several varying models and styles of footwear that place the foot in this declined position. This art is directed to footwear for everyday use and towards an entire shoe. However, this prior art is not specifically designed for exercise, is not removable, and is not adaptable to varying exercises. Therefore, there is a need for a removable device used for exercise that places the foot in an declined position with the toes raised relative to the heel.

SUMMARY OF THE INVENTION

The present invention provides a removable exercise attachment to the footwear of the user. This device is easily strapped onto the forefoot portion of a users existing shoe and includes a base. The base conforms to the bottom forefoot portion of the users shoe and is constructed out of a durable and resilient material. The lower part of the base includes an accessory engagement groove that allows for the attachment of various accessories. Preferably this groove extends the width of the base perpendicular to the length of the shoe and is of a common dovetail variety.

The accessory will have a projection corresponding to the shape of the accessory engagement groove to allow the accessory to be engaged with the base. Preferably, the accessory is slidably received within the dovetail groove of the accessory engagement groove. A multitude of interchangeable accessories are available for various types of exercises, level of activity, and requirements for the proper form of the exercise to be completed. Anticipated accessories are a wheel with varying heights and different shapes, materials, and heights of sole.

In an alternate embodiment the base will be constructed directly into the sole of the forefoot portion on the shoe. This shoe will be specifically designed for use with the various accessories and provide an alternative to the removable device.

In use for a given activity, a user will determine the exercise to be completed choose the proper accessory for the given exercise, affix the accessory to the base, and then affix the base to the forefoot portion of the shoe using the strap. The user will then complete the exercise remove the base from the shoe and continue their normal workout. The various accessories will aide in the completion and execution of specific exercises. For example a user intending to complete "mountain climbers," an exercise were the user places their extended arms palms downward on the floor and supports themselves in the prone position, and extends their legs rearward, alternating each leg, will use a wheel accessory. This wheel accessory will ensure that the user uses the proper form by keeping their body low and feet in contact with the floor engaging their core muscles and preventing the user from jumping or putting added strain on their joints.

A user intending to a do a basic squat or lunge exercise will select an accessory with a heightened sole. This heightened sole will force the user to use the preferred and proper form by raising the user's toes and forcing the user's heel into the ground. This will allow the user to work the proper muscles during this exercise and minimize any potential injury by ensuring the user is in the proper anatomical position.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein:

FIG. 1 is a side view of the device with a solid bottom accessory in engagement with a shoe according to present invention;

FIG. 1A is a side view of the device with a wheel accessory in engagement with a shoe according to the present invention;

FIG. 2 is a top view of the device according to present invention;

DETAILED DESCRIPTION OF THE INVENTION

Figure 3:
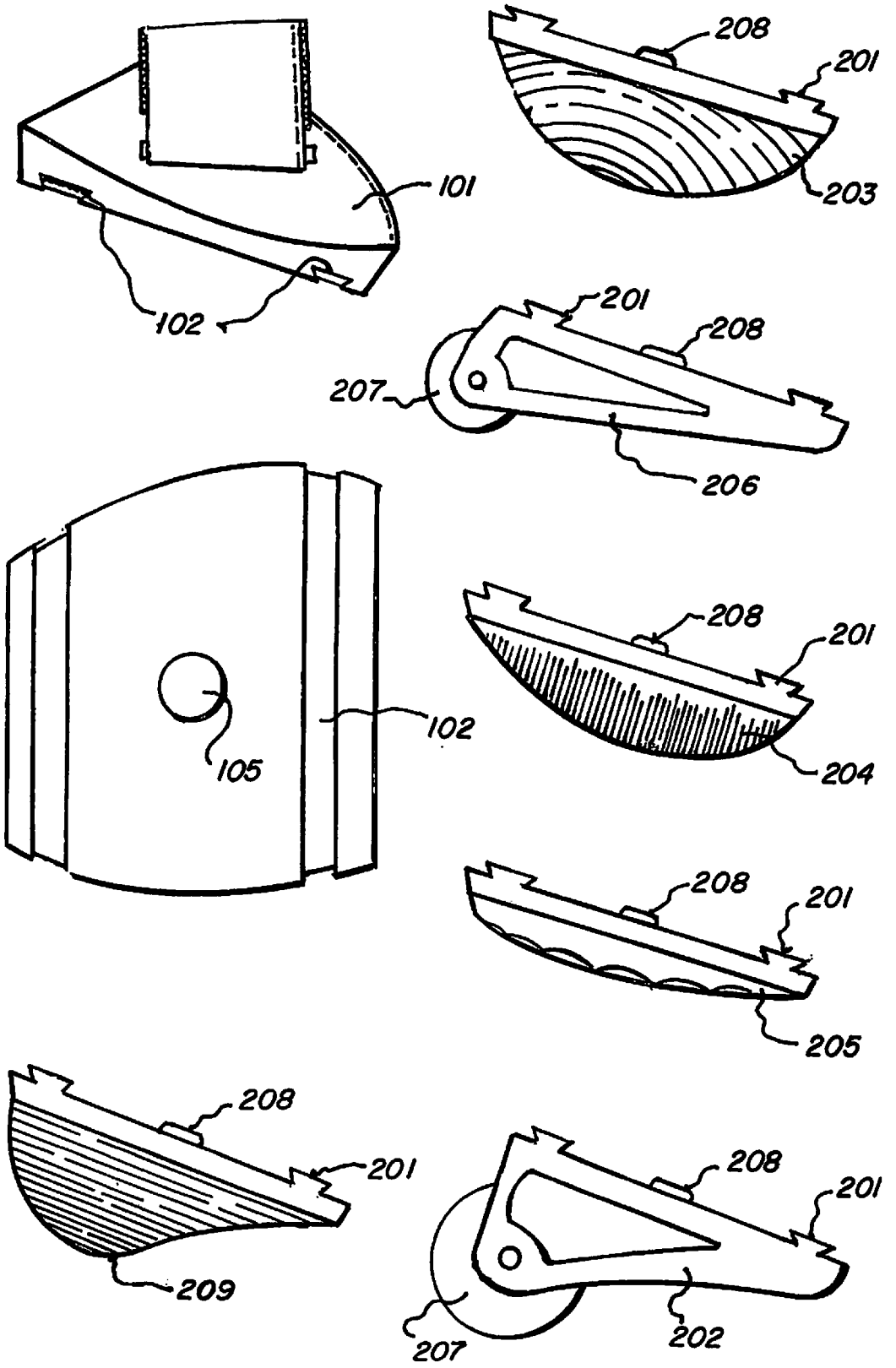
FIG. 3 is views of the device and a variety of attachments connectable to the device according to present invention.

Referring now to FIGS. 1-3 of the removable exercise attachment device for footwear generally referred to as 100 and designed to place the user's foot in a declined position with the toes higher than the heel. There is shown a shoe 10. The shoe 10 is depicted as a standard athletic shoe containing a heel portion, forefoot portion, upper portion, and sole.

The device 100 is removably attached to the shoe 10 using a strap 103. The device 100 includes a base 101, an accessory engagement groove 102, the strap 103, and an accessory 200. The strap 103 is attached to the base and extends up and over the toe of the shoe 10 upper opposite the sole and perpendicular to the length of the shoe 10. The strap 103 is adjustable to accommodate a wide range of shoe sizes and types. Preferably the strap 103 utilizes a hook and loop style closure due to its ease of adjustability, although other fastening methods such as buckles, snaps, or clips may be used.

Additionally, an additional strap 103 may be used to secure the device 100 to the shoe 10 heel by extending parallel to the sole and around the heel of the shoe 10 with each end of the strap 103 affixed to an edge of the device 100.

The base 101 top side provides a platform in communication with the sole of the shoe and has a width and length to accommodate the forefoot portion of a shoe substantially encompassing the forward or toe portion of the shoe. The base 101 top side may include an anti-skid portion in communication with the sole of the shoe 10 to prevent slippage during use.

The base 101 bottom side includes the accessory engagement groove 102 and a central aperture 105. The accessory engagement groove 102 extends the width of the base perpendicular to the length of the shoe 10 and receives a pin 201 present on the accessory 200. The accessory engagement groove may have a lip present on an end to ensure that accessory 200 is fully engaged in the base 101. The preferred shape of the accessory engagement groove 102 is a dovetail shape to securely hold the accessory 200 and distribute the forces of exercise throughout the base 101. The central aperture 105 is located central to the base 101 bottom side and is designed to receive a raised detent 208 present on the accessory 200 top. Preferably the base 101 is constructed out of a durable moldable plastic for its cost, durability, and flexibility and includes two accessory engagement grooves 102.

The accessory 200 includes the pin 201 and raised detent 208 on its top edge. The pin 201 is shaped to correspond to and be slidably received in the accessory engagement groove 102. Preferably the pin 201 is tail shaped to be received in the dovetail shaped accessory engagement groove 102. The raised detent 208 is shaped to correspond to and be received in the central aperture 105. The raised detent 208 provides confirmation and security to the user to ensure the accessory 200 is properly seated in the base 101. Preferably the raised detent 208 is spring loaded to allow the user to easily disengage the raised detent 208 from the central aperture 105.

The accessory 200 may include a wheel 207 or a solid bottom 203. The wheel 207 is provided in varying sizes and heights for various exercises, as shown in a short wheel accessory 206 and a larger wheel accessory 202. The solid bottom accessory 203 is available in several different sizes, shapes, and materials to allow customization by the user for specific exercises as seen in a small solid bottom accessory 204, a short solid bottom accessory 205, and a pointed solid bottom accessory 209. All of the various accessories are easily interchangeable for various exercises and workouts. Although several various and different accessories are disclosed, there are several other configurations, materials, and shapes that may be used. Various materials may be rubber, foam, plastic, an air bladder, or other resilient and durable material.

In any given workout or exercise a specific type of accessory may be desired based upon the demands of the exercise or the body movements associated with that exercise. When doing a squat or lunge exercise it is desired that the users toes be positioned higher than the users heel to ensure proper form and reduce the strain on the users joints, therefore a user may use the solid bottom 203 accessory. Depending upon the user's ability they may wish to use a higher or lower decline by using an accessory such as the short sold bottom accessory 205. When doing an exercise that requires movement of the individual's legs they may prefer to use the wheel 202 accessory. This is especially desirable when doing an exercise such as a "mountain climber." To vary the degree of difficulty of this type of exercise a user may wish to use the short wheel accessory 206 or the larger wheel accessory 202.

In use, a user will attach the device 100 to the forefoot of the toe portion of their shoe 10. To do this, a user will engage the top of the base 101 with the sole of the shoe 10 and securely affix the device 100 to the shoe 10 using the strap 103. The user will then select the appropriate accessory 200 for the workout and slidably engage the pin 201 in the accessory engagement groove 102. The user will ensure the accessory 200 is secure by aligning the raised detent 208 in the central aperture 105. To change accessories a user will press the raised detent 208 to disengage it from the central notch 105 and slide the accessory 200 off of the base 101.

Figure 4:
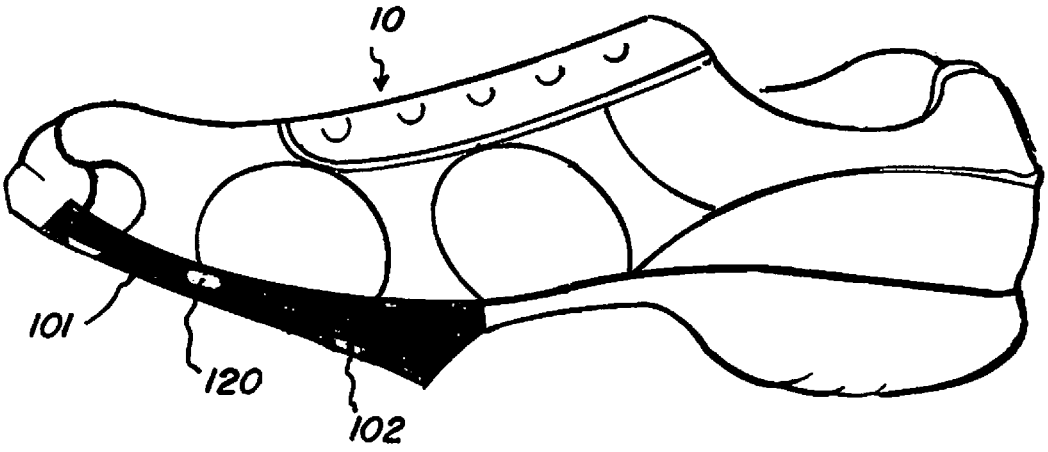
FIG. 4 is a side view of an alternate embodiment according to the present invention.
Figure 5:
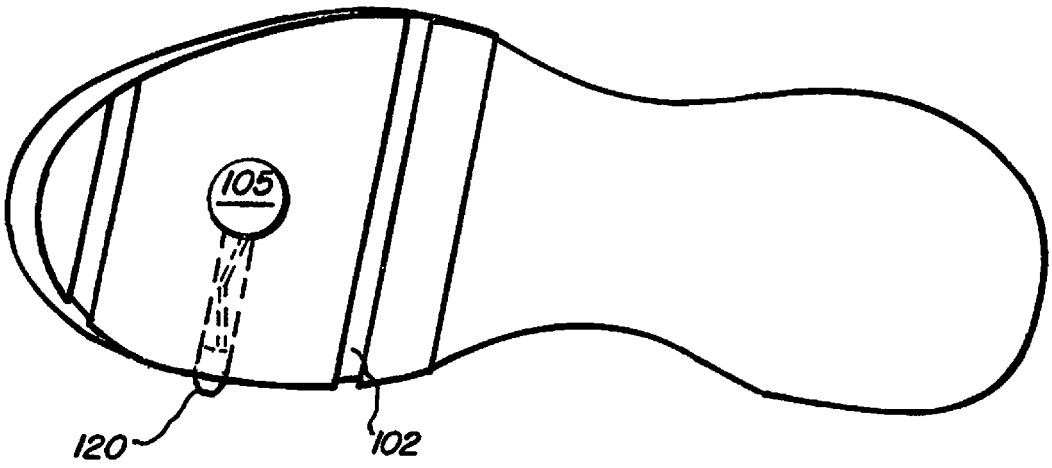
FIG. 5 is a bottom view of the alternate embodiment according to the present invention.

Referring now to FIGS. 4-5 a side view and top view of an alternate embodiment of the present invention there is shown the shoe 10. The shoe 10 has an integrated base 101 according to the present invention. This base 101 has been directly constructed into the sole of the shoe 10. This base includes the accessory engagement groove 102, the central aperture 105, and a spring loaded release 120. The spring loaded release 120 is located exterior to shoe 10 and when pressed disengages the raised detent 208 from engagement with the central aperture 105. According to this embodiment of the present invention, the various accessories previously disclosed will interchangeably be received within the base 101. In use a user will place the shoe with the integrated base onto their foot and select their desired accessory for the exercise to be done.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A device for removable attachment to a forefoot portion of a sole of a shoe to facilitate exercise, the device comprising:

a base portion, the base portion in removable communication with the bottom of the forefoot portion of the sole of the shoe extending from a toe portion of the shoe to an arch portion of the shoe and extending a width of the shoe, the base portion having:

a top side, the top side contacting the sole of the shoe in the forefoot portion;

a bottom side, the bottom side having a accessory engagement groove; and a central aperture, the central aperture positioned at a central position of the accessory engagement groove an accessory portion, the accessory portion in removable communication with the base portion and extending the width of the base portion, the accessory portion shaped to place a user's foot in a declined position, with user's toes elevated higher than user's heel, the accessory portion having:

a pin, the pin shaped for receipt within the central aperture of the accessory engagement groove; and a strap, the strap attached to the base and securing the base to the shoe.

2. The device as in claim 1, wherein the central aperture shaped to receive a raised detent, the raised detent located on the accessory portion, the raised detent ensuring that the accessory portion is engaged within the base portion.

3. The device as in claim 2, wherein the raised detent is spring loaded.

4. The device as in claim 1, wherein the accessory portion includes a wheel.

5. The device as in claim 1, wherein the accessory portion includes a solid bottom.

6. The device as in claim 1, wherein the accessory portion is interchangeable.

7. The device as in claim 1, wherein the top side includes an anti-skid surface.

8. The device as in claim 1, wherein the base is integrated into the sole of a shoe.

9. A device for removable attachment to a forefoot portion of a sole of a shoe to facilitate exercise, the device comprising:

a base portion, the base portion in removable communication with the bottom of the forefoot portion of the sole of the shoe extending from a toe portion of the shoe to an arch portion of the shoe and extending a width of the shoe, the base portion having:

a top side, the top side contacting the sole of the shoe in the forefoot portion; and a bottom side, the bottom side having:

an accessory engagement groove, the accessory engagement groove having a dovetail shape, the accessory engagement groove extending the width of the base perpendicular to a length of the shoe; and a central aperture, the central aperture centrally located within the accessory engagement groove;

an accessory portion, the accessory portion in removable communication with the base portion and extending the width of the base portion, the accessory portion shaped to place a user's foot in a declined position with user's toes elevated higher than user's heel, the accessory portion having:

a pin, the pin tail shaped for receipt within the accessory engagement groove dovetail; and a raised detent, the raised detent shaped for receipt within the central aperture, wherein the raised detent provides confirmation of the proper engagement between the accessory portion and the base portion;

a strap, the strap attached to the base and securing the base to the shoe.

10. The device as in claim 9, wherein the accessory portion includes a wheel.

11. The device as in claim 9, wherein the accessory portion includes a solid bottom.

12. The device as in claim 9, wherein the accessory portion is interchangeable.

13. The device as in claim 9, wherein the top side includes an anti-skid surface.

14. The device of claim 9, wherein the base is integrated within the sole of a shoe.

* * * * *